US005199572A

United States Patent [19]

Abe

[11] Patent Number: 5,199,572

[45] Date of Patent: Apr. 6, 1993

[54] BALLOON STORAGE SYSTEM AND METHOD FOR ASSEMBLING THE SAME

[76] Inventor: Seietsu Abe, Nichimo Co., Ltd. 6-2, 2-chome, Ohtemachi, Chiyoda-ku, Tokyo, Japan

[21] Appl. No.: 644,734

[22] Filed: Jan. 23, 1991

Related U.S. Application Data

[63] Continuation of Ser. No. 375,590, Jul. 5, 1989, abandoned.

[51] Int. Cl.[5] ..... B65D 77/00; B65D 85/00

[52] U.S. Cl. ..... 206/526; 206/527; 150/154; 383/42; 383/72; 446/220; 244/31; 244/33

[58] Field of Search ..... 206/526, 527; 383/72, 383/76, 907, 71, 42; 150/154; 446/220, 221, 225, 475; 141/313, 314; 112/438; 2/409; 244/31, 33; 116/210, DIG. 8, DIG. 9; 343/706

[56] References Cited

U.S. PATENT DOCUMENTS

| | | | |
|---|---|---|---|
| 2,731,054 | 1/1966 | Driben | 150/154 |
| 3,322,176 | 5/1967 | Geller | 383/907 |
| 3,550,662 | 12/1970 | Remke | 206/527 |
| 4,351,068 | 9/1982 | Taylor | 2/409 |

FOREIGN PATENT DOCUMENTS

| | | | |
|---|---|---|---|
| 112972 | 4/1941 | Australia | 383/72 |
| 402983 | 10/1909 | France | 446/225 |
| 1545760 | 9/1967 | France | 206/526 |
| 38441 | 10/1965 | German Democratic Rep. | 446/220 |

OTHER PUBLICATIONS

Federal Standard No. 751, Aug. 14, 1959 "Stitches, Seams and Stitchings".

*Primary Examiner*—David T. Fidei

[57] ABSTRACT

A balloon storage system which is disclosed wherein comprises at least one cylinder-like or bag-like storage for storing balloons packed therein, which is formed by locking meshes at any places of a pet having meshes of a diameter smaller than the diameter of the balloon, so that the balloons packed in the storage can be released off to the outside by releasing the locking of the openable locations of the locked portions of the net to open the storage. In this balloon storage system, the openable locations of the net is releasably locked by chain-binding with a knot smaller in diameter than the diameter of the balloon by means of a locking element.

18 Claims, 7 Drawing Sheets

BALLOON STORAGE SYSTEM AND METHOD FOR ASSEMBLING THE SAME

This application is a continuation, of application Ser. No. 07/375,590, filed Jul. 5, 1989 now abandoned.

FIELD OF THE INVENTION

The present invention relates to a balloon storage system which is utilized for entertainments such as various events and an advertisement and in which a large number of balloons filled or inflated with helium gas or the like lighter than air are once stored in a storage and as required, the storage is opened to release the balloons to the outside, and to a method for assembling the same.

BACKGROUND OF THE INVENTION

Such balloon storage systems have conventionally been used to give entertainments, but the prior art systems are of a relatively small scale and store a large number of balloons having various different colors only for flying off them into the air, and their structures are simple.

At present, however, a balloon storage system of a large scale is required, and it is also required that rather than storing of balloons in order to merely fly off them as in the prior art, balloons of various different colors are once moored in a stationary condition to describe letters, figures, designs, pictures or the like, so that such stationary patterns may be enjoyed by viewers, and thereafter, the storage is opened to fly off the balloons therein to the outside.

FIGS. 1 to 4 illustrate one example of the prior art balloon storage system formed to meet the above demands.

This prior art example is designed to form a stationary pattern along a side wall face of a building. One example of such stationary pattern describes large X and small M A S.

The prior art system is constituted of a combination of a large number of storage units 1, 1 - - - . Each storage unit 1 is formed by double folding a single net 2, locking the overlapped end edges to form a storage 3, and packing a large number of balloons 4, 4 - - - of predetermined colors into the storage 3. The illustrated prior art example has a storage unit 1 formed into an elongated configuration. More specifically, as shown in FIG. 2, an oblong net 2 is double folded so that its longer end edges 2*a*, 2*a* may be mated, and a lacing 5 is passed through meshes at ends of the overlapped longer and shorter end edges 2*a*, 2*a* and 2*b*, 2*b*, as shown in FIG. 4 to lock them, thereby providing a storage 3. A large number of inflated balloons 4, 4 - - - are packed into the storage 3 to expand the storage 3 itself into a cylinder form. The large number of storage units 1, 1 - - - containing the balloons 4 of individual colors are moored on a side wall face or the like of a building in such a manner to describe a stationary pattern of X and M A S, thus providing this pattern for a visual enjoyment.

When the balloons 4 in the storage 3 are then to be released, the lacing 5 is drawn from one end and away out of the meshes at a timing of release in the entertainment to unlock the longer and shorter end edges 2*a* and 2*b* of the net 2 and thus, the storage 3 is opened to release the balloons 4, 4 - - - therein with their ascending forces.

FIGS. 5 to 8 illustrate another example of the prior art balloon storage system formed to meet the above-described demands.

This example is intended to form a stationary pattern along a side wall face of a building, and one example of such stationary pattern is comprised of a red letter of A, a yellow letter of B and a blue letter of C described on an oblong (long from side to side) white substrate.

In Figures, the reference character 6 is a lower net having a size corresponding to that of the oblong white substrate, with meshes of the lower net 6 being formed smaller than the diameter of the balloon 4. As shown in FIG. 5, a draft for profiles of three letters A, B and C has been previously drawn on the lower net 1 with a coating. Four upper nets 7 and 7*a* as shown in FIG. 7 are attached on the surface of the lower net 1 to form multiple net bag-like divided storages 8, 8 - - - which each contain a large number of balloons 4, 4 - - - between the upper and lower nets, as shown in FIG. 8.

Further, each of the four upper nets 7 and 7*a* has meshes smaller than the balloon 4 and is of a shape such as that the lower net 6 is cut widthwise, wherein the two upper nets 7*a* and 7*a* at left and right opposite ends are of the same shape, while the two upper intermediate nets 7 and 7 are of the same shape. The upper intermediate nets 7 have a width two times the width of the upper end nets 7*a*. These upper nets 7, 7*a* are previously secured to the lower nets 6 at their portions of a longitudinal side $\overline{ad}$, a center line $\overline{fi}$, a center line $\overline{lo}$ and a longitudinal side $\overline{rs}$ as shown in sequence from the left to the right in FIG. 6. Such securing of the upper nets 7, 7*a* to the upper net 6 may be performed, for example, by passing a fixing rope 9 through meshes of the both nets 6, 7 and 7*a*. It should be noted that the respective sides $\overline{ab}$ to $\overline{ts}$ of the upper nets 7, 7*a* other than the secured portions serve as openable locations or portions and are releasably locked to the lower net 1 by a lacing 5. Further, those portions of the upper nets 7, 7*a* which correspond to the profiles of three letters A, B and C already drawn on the lower net 6 are releasably locked to the lower net 6 by the lacing 5 to serve as openable locations. Such locking of the upper nets 7, 7*a* to the lower net 6 by the lacing 5 is performed in sequence from uppermost one to lowermost one of the openable locations. Packing of balloons 4 into the storage 8 is carried out by making an advance of locking of the upper nets 7, 7*a* to the lower net 6 by the lacing 5, while at the same time filling the balloons 4 of various colors with helium gas for inflation at the stage of the storage 8 opened at its lower portion being formed, binding and closing the openings and then placing the balloons into the storage from the below. Such packing of the balloons 4 and such locking by the lacing 5 are conducted while moving the whole of the lower and upper nets 6, 7 and 7*a* upwardly along a side wall face of a building. By conducting these operations down to the respective lowermost sides $\overline{dc}$, $\overline{jh}$, $\overline{pn}$ and $\overline{ts}$ of the upper nets 7, 7*a*, assembling of a balloon storage system is completed.

This results in a completed balloon storage system presenting a stationary pattern comprised of a red letter of A, a yellow letter of B and a blue letter of C formed on a white substrate by the large number of balloons 4, 4 - - - , which pattern is provided for a visual enjoyment.

At a proper timing of releasing off the balloons 4 into the air in an entertainment, the individual lacings 5 are drawn out to unlock the upper nets 7, 7*a* from the lower net 6, thereby opening the individual storages 8. This causes the balloons 4, 4 - - - in the storages to be released off to the outside.

In the prior art example shown in FIGS. 1 to 4, however, the lacing 5 is sequentially passed through the meshes at the ends of the longer and shorter end edges 2a and 2b of the net 2 to lock the end edges 2a and 2b in order to form the storage 3. Therefore, the following problem is encountered: In releasing off the balloons 4, a very large force is required to draw the lacing 5 out of the individual meshes, and a failure of drawing may occur in some cases to result in no balloons released off.

In addition, in the prior art example shown in FIGS. 5 to 8, the locking of the openable portions of the upper nets 7, 7a to the lower net 6 is performed by sequentially passing, for example, a lacing 5 thicker than the yarns of the nets 6, 7 and 7a as shown in FIG. 8 through the meshes of the nets 6, 7 and 7a. Therefore, this prior art example is accompanied by the following problem: To release the locking provided by the lacing 5, the latter must be drawn out of the meshes, and a very large force is required for such drawing. Also, in some cases, a failure of drawing may occur to result in no balloons 4 released off.

Such problems arise by the following reasons: a large ascending force provided by the balloons 4, 4 - - - contained in each of the storages 3, 8 acts on the individual nets 2, 6, 7 and 7a forming the storages 3, 8. At the portions locked by the lacing 5, this ascending force acts as a force of drawing the adjacent meshes locked by the lacing 5 away from each other and hence, the frictional force between the lacings 5 and the feet of the nets 2, 6, 7 and 7a is extremely large, resulting in a large force required to draw out the lacings 5 against the frictional force during unlocking. Particularly, if the portions locked by the lacings 5 is bent at an acute angle or curved rather than being rectilinear, a force required for drawing the lacings 5 is further larger and as a result, the drawing may be impossible to fail the releasing off the balloons 4 in some case. In addition, the lacing 5 must be increased in diameter so as to withstand a larger drawing force.

Therefore, it is not possible to provide a free adjustment, for example, for synchronizing or staggering the timings of releasing, into the air, the balloons in the different portions of the stationary pattern presented by the balloon storage system. The stationary pattern may be limited to those of a combination of straight lines and hence, it is impossible to make a stationary pattern having an unrestricted shape.

Additionally, in the prior art example, to pack the balloons 4 into each of the storages 3, 8 in assembling the entire system, the openings are bound and closed and then, the balloons are packed after they have been filled with helium gas and inflated into a size larger than the meshes of the nets 2, 6, 7 and 7a. For this reason, while the openable portions of the storage 3, 8 are being locked by the lacing 5, the balloons 2 of a predetermined color must be packed into the storage 3, 8 opened at its lower portion. In this manner, in the prior art example, the locking of the storage by the lacing 5 and the packing of the balloons 4 into the storage 3, 8 must be concurrently conducted, attendant with the following problems: Many labors as well as a long time are required for the assembling operation and hence, it is impossible to produce a large scale system. Particularly, the locking operation using the lacing 5 must be conducted on the site where an entertainment is given, and there is a fear that a stationary pattern different from a desired pattern may be produced due to mistaking of the locked portions. A further problem is as follows: If the wind is blowing, the nets 2, 6, 7 and 7a are swayed, resulting in a degraded workability, wherein the balloons may fly away or burst. In order to overcome these disadvantages, if an attempt is made to conduct the locking by the lacing 5 and the packing of the balloons 4 into the storage 3, 8 in a flatland and to place the completed entire system onto a side wall face of a building, the following problems are encountered: A large space is required to transport an entire large system packed with balloons 4 to the site, and if the wind is blowing, the transporting may be impossible in some cases. In addition, a large-scaled hanging apparatus is required for hanging up a large-sized system along a wall face of a building, leading to an increase in cost.

BRIEF SUMMARY OF THE INVENTION

The present invention has been accomplished with the foregoing in view, and it is an object of the present invention to provide a balloon storage system which is capable of providing a stationary pattern of any shape, wherein in forming a cylinder-like or bag-like storage into which balloons are contained by locking ends or any other places of a net or nets, openable locations or portions for releasing off the balloons in the storage can be locked to such an extent to ensure that they can be reliably unlocked and yet, any larger force is not required for such unlocking and if the openable locations are acutely bent, they can be easily unlocked.

It is another object of the present invention to provide a balloon storage system capable of presenting a stationary pattern of any shape which is complicated and includes many curved lines, wherein openable locations or portions of an upper net can be reliably and releasably locked to a lower net and yet, any larger force is not required for releasing such locking, and the locked portions can be unlocked at any time.

It is a further object of the present invention to provide a process for assembling a balloon storage system which is inexpensive in cost, wherein balloons each having a check valve are employed to enable the assembling operation to be simply and rapidly conducted by first locking a net material by a locking element and after completion of the locking, packing the balloons into a net bag and to reliably assemble the system according to a desired stationary pattern, and moreover, the balloons can be packed without being influenced by the wind.

According to the present invention, the first object is attained by providing a balloon storage system comprising at least one cylinder-like or bag-like storage for storing balloons packed therein, which is formed by locking meshes at any places of a net having meshes of a diameter smaller than the diameter of the balloon, so that the balloons packed in the storage can be released off to the outside by releasing the locking of the openable locations of the locked portions of the net to open the storage, wherein the openable locations of the net are releasably locked by chain-binding with a knot smaller in diameter than the diameter of the balloon by means of a locking element.

With such a construction, since the openable locations of the net are releasably locked by chain-binding with a knot smaller in diameter than the diameter of the balloon by means of a locking element, and therefore, in forming the cylinder-like or bag-like storage for containing balloons by locking the meshes of the net, the openable locations for releasing off the balloons in the storage can be reliably and releasably locked and yet, any larger force is not required for releasing such locking. Even if the openable locations are acutely bent, such locking can be simply and reliably released to form a stationary pattern of any shape. This makes it possible to provide an increase in size of the stationary pattern, leading to effects such as an increased aesthetic impact to viewers and an extreme increase in utility value for an entertainment.

In addition, according to the present invention, the second object is achieved by providing a balloon storage system comprising a lower net having meshes smaller than the diameter of a balloon, and an upper net having meshes also smaller than the diameter of the balloon and supporting the balloon from the above, the upper net having portions secured to the lower net and openable locations or portions releasably locked to the lower net to form a storage which stores the balloons packed therein, so that the balloons packed in the storage can be released off to the outside by releasing the locking of the openable locations of the upper net to the lower net to open the storage, wherein the openable locations or portions of the upper net are releasably locked to the lower net by chain-binding with a knot smaller than the diameter of the balloon by means of a locking element.

Even with such construction, since the openable locations or portions of the upper net are chain-bound to the lower net with a knot smaller than the diameter of the balloon by means of the locking element, the openable locations of the upper net can be reliably and releasably locked to the lower net and yet, any larger force is not required to release such locking, and a plurality of the locked portions can be unlocked at any time. This makes it possible to form a stationary pattern of any shape comprised of pictures such as including a large number of complicated curves and to provide an increase in size of the stationary pattern, leading to effects such as an increased aesthetic impact to viewers and an extreme increase in utility value for an entertainment.

Further, according to the present invention, the third object is achieved by providing a process for producing a balloon storage system, comprising the steps of: locking a net having meshes smaller than the diameter of a balloon by a locking element to form a storage for storing balloons; inserting uninflated balloons each having a check valve through the meshed into the storage; and filling a gas through the check valve into each of the balloons to inflate the balloons into a diameter larger than the meshes, thereby storing the inflated balloons in the storage, so that when the locking by the locking element is thereafter released, the balloons can be released off to the outside of the storage.

With the above process, the balloons having the check valve are used to enable the assembling operation to be simply and rapidly conducted by first locking a net material by a locking element and after completion of the locking, packing the balloons into a net bag and to reliably assemble the system according to a desired stationary pattern. Moreover, the balloons can be simply packed without being influenced by the wind, leading to a reduction in assembling cost.

BRIEF DESCRIPTION OF THE DRAWINGS

FIGS. 1 to 4 illustrate a prior art system, wherein

FIG. 1 is a front view of a stationary pattern;

FIG. 2 is a perspective view of an essential portion of the system;

FIG. 3 is a sectional view taken along a line III—III in FIG. 2; and

FIG. 4 is an enlarged view of a portion indicated by IV in FIG. 2;

FIGS. 5 to 8 illustrate another prior art balloon storage system, wherein FIG. 5 is a front view of the system in the assembled state;

FIG. 6 is a front view of the system in the disassembled state;

FIG. 7 is a sectional view taken along a line VII—VII in FIG. 5; and

FIG. 8 is an enlarged view of a portion indicated by VIII in FIG. 5;

FIGS. 9 to 11 illustrate a balloon storage system according to one embodiment of the present invention, wherein FIG. 9 is a perspective view of the balloon storage system;

FIG. 10 is an enlarged view of a portion indicated by X in FIG. 9; and

FIG. 11 is a sectional view of a balloon having a check valve;

FIGS. 14 to 17 illustrate a further embodiment of the present invention, wherein FIG. 14 is a front view of the system in an assembled state;

FIG. 15 is a front view of the embodiment of FIG. 14 with the upper net detached.

FIG. 16 is a sectional view taken along a line XVI—XVI in FIG. 14; and

FIG. 17 is an enlarged view of a portion indicated by XVII in FIG. 14.

DETAILED DESCRIPTION OF THE EMBODIMENTS

Figure 1:
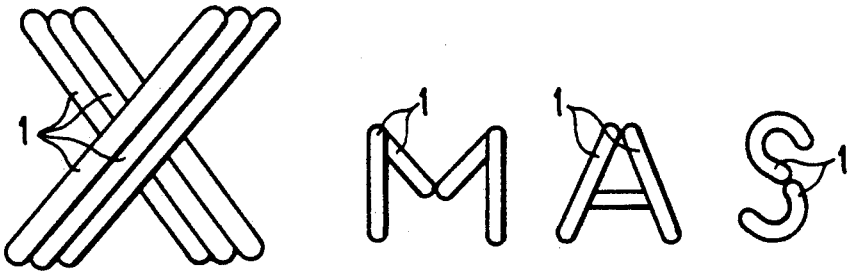
FIG. 1 (PRIOR ART)
Figure 2:
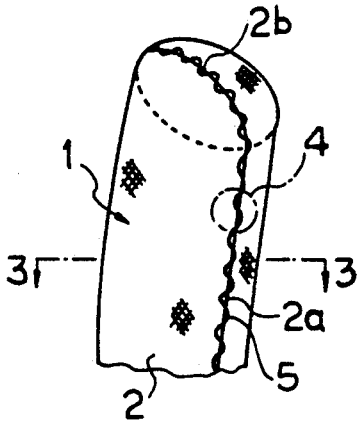
FIG. 2 (PRIOR ART)
Figure 3:
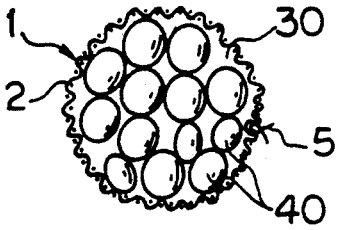
FIG. 3 (PRIOR ART)
Figure 4:
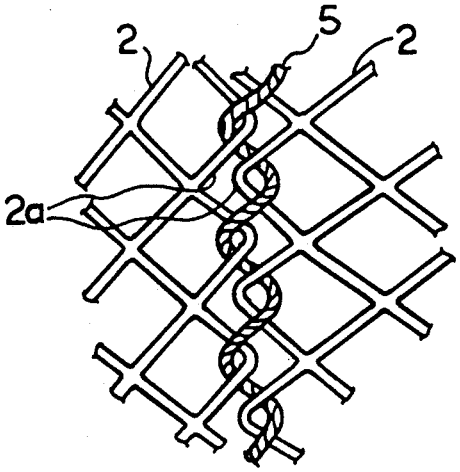
FIG. 4 (PRIOR ART)
Figure 5:
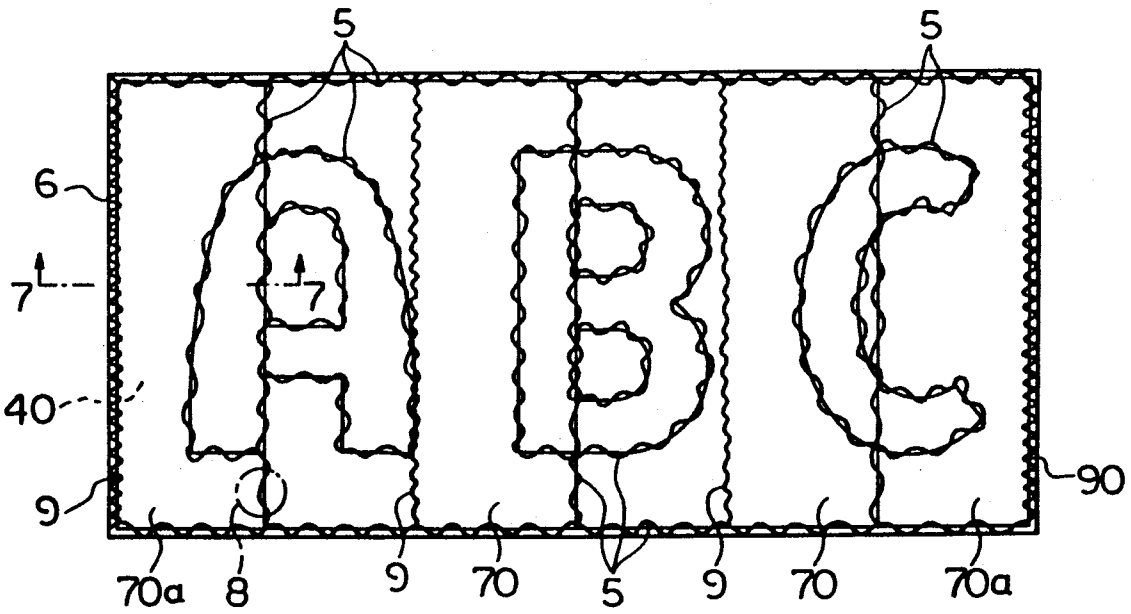
FIG. 5 (PRIOR ART)
Figure 6:
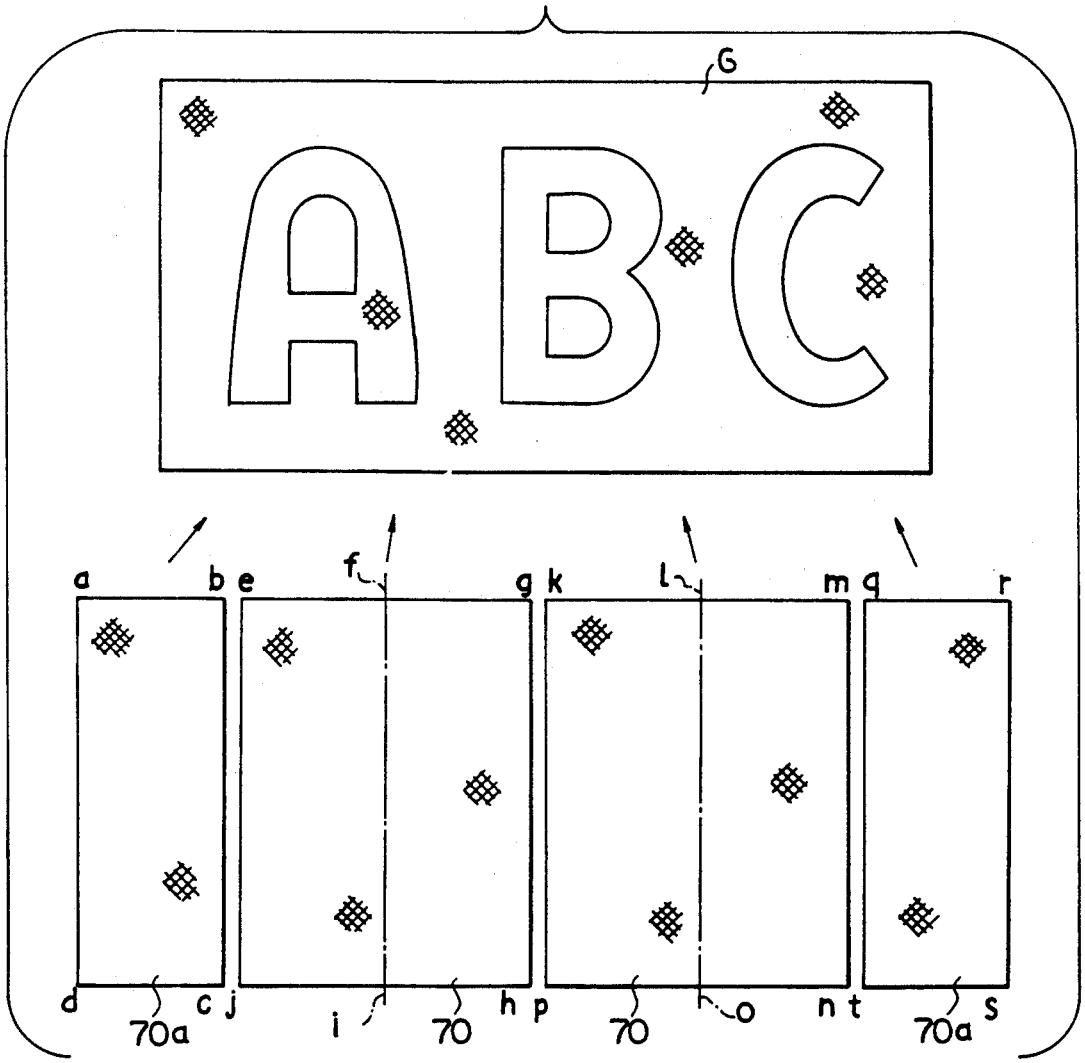
FIG. 6 (PRIOR ART)
Figure 7:
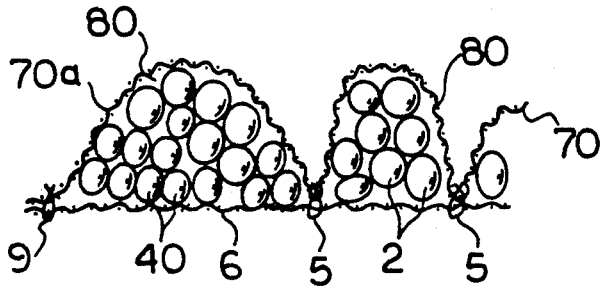
FIG. 7 (PRIOR ART)
Figure 8:
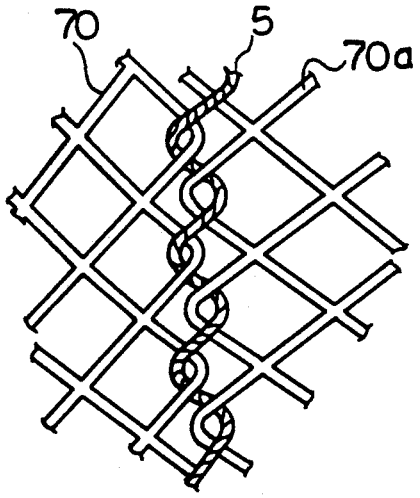
FIG. 8 (PRIOR ART)

The present invention will now be described by way of one embodiment with reference to FIGS. 9 to 13.

Referring first to FIGS. 9 to 13, there is illustrated a balloon storage system according to one embodiment of the present invention, wherein portions corresponding to those in the prior art system are designated by the same reference characters.

Figure 9:
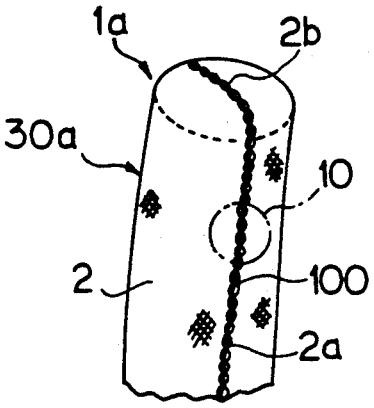
Figure 10:
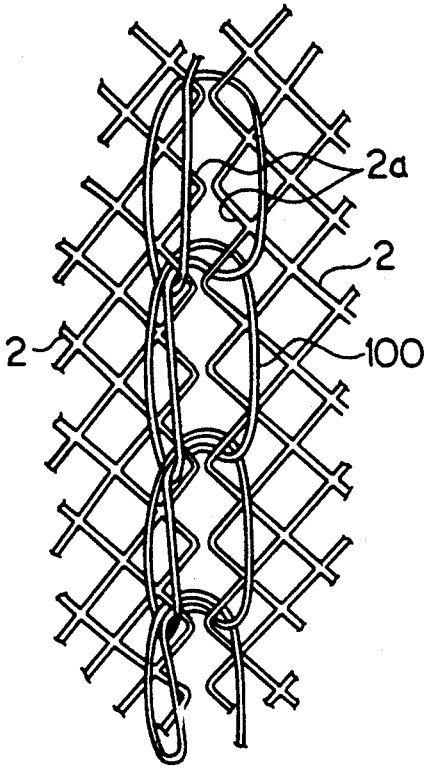

As shown in FIGS. 9 and 10, a storage 3*a* is formed by chain-binding openable locations or portions provided by longer end edges 2*a*, 2*a* and shorter end edges 2*b*, 2*b* of a double-folded net 2 by use of a locking element 10 in place of the conventional lacing 5 to releasably lock them. The locking element 10 used may be one selected from a rope, a string, a twine, a thread and the like, and in this embodiment, a rope is used. The locking by the locking element 10 may be performed by chain-binding in such a manner that the locking element 10 is entangled in meshes of each end edge 2*a*, 2*b*, rather than by passing the lacing itself through the meshes of each end edge 2*a*, 2*b* as in the locking by the lacing 5, and therefore, the locking operation is extremely facilitated. However, the size of a knot formed between the locking element 10 and each end edge 2*a*, 2*b* by entangling of the locking element should be smaller than the diameter of an inflated balloon 4.

Figure 11:
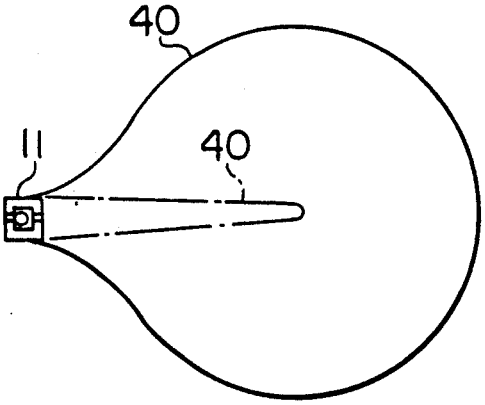

The completion of the locking by the locking element 10 results in a storage 3*a* formed. Then, a balloon having a check valve 11 as shown in FIG. 11 is packed into the storage 3*a*. More specifically, the balloon 4 left in an uninflated state (shown by a broken line in FIG. 11) unfilled with helium gas or the like is placed into the storage 3*a* through the meshes of the net 2. Then, helium gas is filled into the balloon 4 through the check valve 11 using a proper filling nozzle (not shown) to inflate the balloon into a size larger than the mesh of the net 2, and when the filling nozzle is moved away from the check valve 11, the latter is fully closed automatically. In this manner, a large number of the balloons 4, 4 - - - are packed in the storage 3*a* to form an elongated storage unit 1*a*.

Then, the storage unit 1*a* is fixed in a position for a predetermined component of a stationary pattern which is to be formed on a side wall face of a building. This operation is likewise performed for a large number of the storage units 1*a*, 1*a* - - - to give a stationary pattern, for example, as shown in FIG. 1, thus providing the stationary pattern for a visual enjoyment.

Thereafter, when the balloons 4 are to be released off into the air, the locking element 10 may be pulled after the tied end of the locking element has been untied. If doing so, the locking element 10 entangled in the meshes of the end edges of the net 2 is loosed in a direction opposite to a locking direction. In this case, a ascending force provided by the balloon 4 in the storage 3*a* acts as a force in a direction to pull away the end edges 2*a*, 2*b* of the net 2 locked by the locking element 10, and in this embodiment, such ascending force is a force for releasing the locking by the locking element 10 unlike the prior art system. Hence, a larger pulling force is not required for releasing of the locking by the locking element 10 and yet, the releasing of the locking can be reliably and rapidly performed. Accordingly, even if the storage unit 1*a* is acutely bent, then the openable locations of the net 2 can be reliably opened to fly off the balloons 4. Thus, it is possible to determine any shape of the stationary pattern at will and further, to freely select any timing of releasing of the locking at individual components of the stationary pattern.

Figure 12:
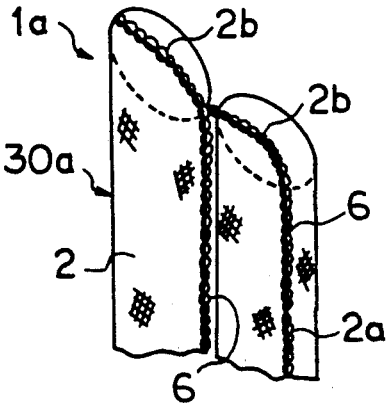
FIGS. 12 and 13 are perspective views of balloon storage systems according to other alternate embodiments of the present invention, respectively.
Figure 13:
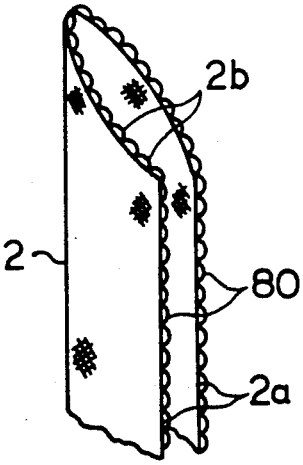
Figure 14:
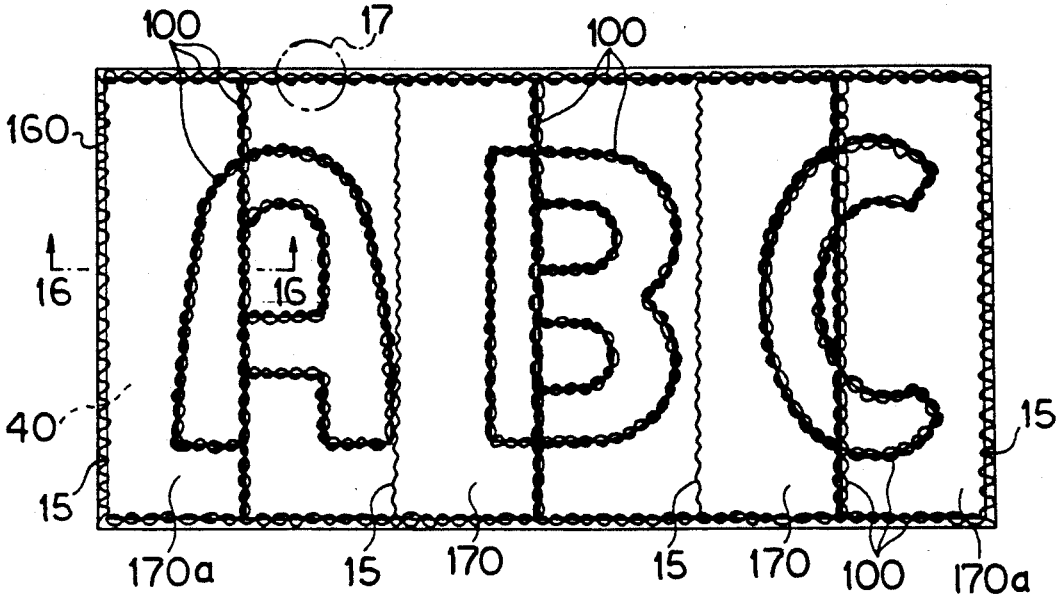

In the above embodiment, the end edges has been locked by the locking element 10 so that the single elongated storage unit 1*a* has been formed from the single net 2, but it will be understood that as shown in FIG. 12, a plurality of storages 3*a*, 3*a* - - -may be formed by locking meshes in face and back portions of a double net 2 resulting from double-folding in parallel to the longer end edges 2*a* by means of the locking element 10, and balloons 4 of different colors may be packed into the individual storages 3*a*, respectively, thereby forming any stationary pattern.

If the mesh of the net 2 is too small to provide the locking by the locking element 10, a locking rope 12 may be fixed to the net 2 at locations longitudinally spaced apart at predetermined distances by proper means in such a manner to form knots smaller than the diameter of the balloons 4, and the locking element 10 may be entangled on the locking rope 12, thereby providing the locking.

While the balloon 4 having the check valve 11 has been employed in the above embodiment, a balloon 4 having no check valve 11 may be used, and such balloons may be packed into the storage 3 after being inflated and then bound or fastened at their openings. In this case, locking of the end edges 2*a*, 2*b* of the net 2 by the locking element 10 may be advanced synchronously with packing of the balloons 4 into the storage 3*a*.

In addition, the shorter end edges 2*b* at the upper end of the net 2 are not locked together as in the above embodiment, and for example, the outer periphery of a circular covering net material (not shown) at the upper end may be releasably locked to the net by the locking element to form a cylindrical storage so that releasing of the locking of such covering net material at the upper end may cause the balloons to be released off through the opening at the upper end of the storage.

Further, although the single net material has been used in each of the above alternative embodiments, a plurality of net materials may be used to form cylinder-like or bag-like storages.

A further embodiment of the present invention will be described below with reference to FIGS. 14 to 17.

Referring to FIGS. 14 to 17, there is shown a balloon storage system according to a further embodiment of the present invention, wherein for convenience of comparison with the prior art system shown in FIGS. 5 to 8, a stationary pattern may be presented where a red letter of A, a yellow letter of B and blue letter of C are arranged on a white substrate as in the prior art system.

As in the prior art system, in the present embodiment, a large number of storages 18, 18 - - -each packed with a large number of balloons 4, 4 - - -are formed by a lower net 16 and upper nets 17, 17*a*. Openable locations or portions of the upper nets 17, 17*a* are releasably locked to the lower net 16 by chain-binding by use of a locking element 10 in place of the conventional lacing 5. The locking element 10 used may be one selected from a rope, a string, a twine, a thread and the like as in the previously described embodiment, and in this embodiment, a rope is used.

Figure 17:
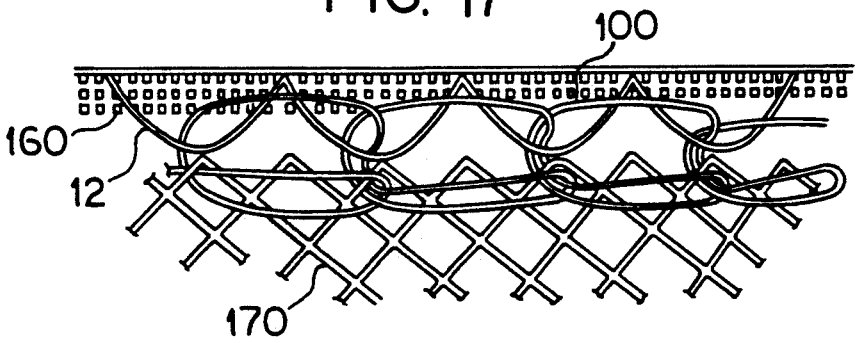
Figure 15:
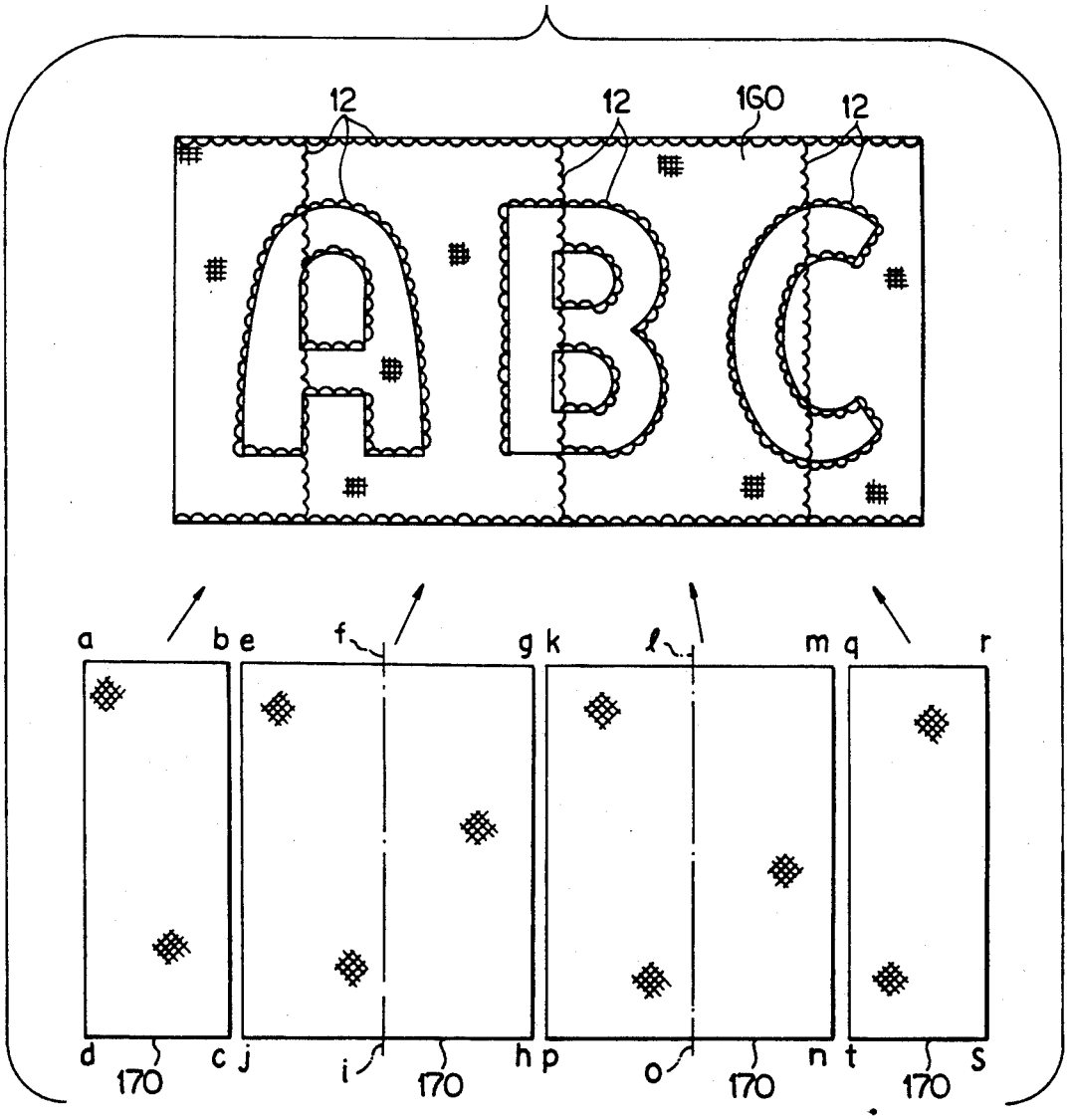

Further, in the present embodiment, the lower net 16, as shown in FIG. 17, has a mesh which is smaller than the balloon 4 and which is square and narrower, so that a draft of profiles of the letters A, B and C can be extremely easily drawn. It is difficult to carry out the locking by the locking element 10 by use of the meshes of the lower net 16 because the mesh of the lower net 16 is square and narrower in this way. Thereupon, in the present embodiment, in order to simply and rapidly conduct the locking operation, locking rope 12, 12 - - - are fixed to the lower net 16 at locations longitudinally spaced apart at predetermined distances to form knots smaller than the diameter of the balloons 4, as shown in FIG. 15 in positions in which the upper nets 17, 17*a* are locked. Such fixing of the locking rope 12 to the lower net 16 may be performed by use of proper means such as fixing by passing the locking ropes 12 through the meshes of the lower net 16 or fastening with another fastening string. The size of the mesh of the four upper nets 17, 17*a* is smaller than the diameter of the balloon 4 and is such that the locking by the locking element 10 can be conducted smoothly. The upper nets 17, 17*a* are formed into shapes corresponding to those resulting from widthwise four-division of the lower net 16 so that the width of two upper nets 17, 17 at the middle may be twice the width of the two upper nets 17*a*, 17*a* at the left and right ends.

The upper nets 17, 17*a* are fixed at their secured locations to the lower net 16 by passing a fixing rope 9 through the meshes of the lower net 16. The secured locations of the upper nets 17, 17*a* are a longitudinal side $\overline{ad}$, a central line $\overline{fi}$, a central line $\overline{lo}$, and a longitudinal side $\overline{rs}$ in sequence from the lefthand net to the right-hand net as viewed in FIG. 17, respectively. On the other hand, the openable locations of the upper nets 17, 17a to be releasably locked to the lower net 16 are sides ab to ts excluding the secured locations, respectively as well as portions at the profiles of the letters A, B and C.

Figure 16:
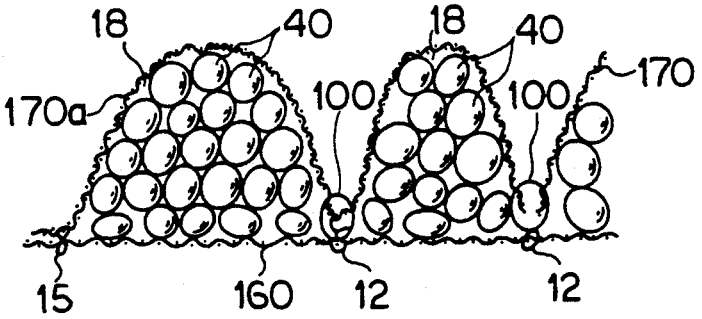

In the present embodiment, the respective openable locations of the upper nets 17, 17a are releasably locked to the lower net 16 by the locking element 10, wherein they are sequentially locked as shown in FIGS. 16 and 17 by use of the meshes for one of the nets, i.e., the upper nets 17, 17a and by use of the locking rope 12 for the other or lower net 16. Such locking by the locking element 10 may be performed by entangling the locking element 10 into the meshes of the upper nets 17, 17a and onto the locking ropes 12 secured to the lower net 16 rather than by completely passing the lacing 5 itself through the meshes of the upper and lower nets 7, 7a and 6 as with the conventional locking by the lacing 5. This leads to an extremely facilitated locking operation. In this case, the size of knots formed between the locking element 10 and the upper nets 17, 17a as well as the locking rope 12 should be smaller than the diameter of an inflated balloon. In addition, the locking of the openable lovations may be carried out using a large number of locking elements 10, 10 - - - , and an extent to be locked by a single locking element 10 may be determined depending upon the shapes of individual components of the stationary pattern, the timing of unlocking the locked portions and the like.

After completion of the locking by the locking elements 10, the resulting lower and upper nets 16, 17 and 17a may be transported to a site where an entertainment is given. Then, balloons each having a check valve 11 as shown in FIG. 11 are packed into a large number of storages 18, 18 - - -formed between the lower and upper nets 16 and 17, 17a. More specifically, the balloons each left in an uninflated state (shown by a broken line in FIG. 11) unfilled with helium gas are placed into each of the storages 18 through the meshes of the upper nets 17 and 17a and then, helium gas is filled into each of the balloons 4 through the check valve 11 using a proper filling nozzle up to a size larger than the meshes of the upper nets 17, 17a. If the filling nozzle is then released from the check valve 11, the latter is fully closed automatically. The balloons 4 of a proper color inflated in this manner are packed into each of the storages 18, as shown in FIG. 16. When the lower net 16 and the upper nets 17, 17a are mounted along a side wall face of a building, such packing of the balloons 4 into the individual storages 18 is sequentially conducted for from uppermost storage 18 to the lowermost storage, while the lower and upper nets 16 and 17, 17a are being hung upwardly.

Upon completion of such packing of the balloons 4, a stationary pattern is formed by the balloons 4 of a plurality of colors and provided to a visual enjoyment.

Thereafter, in releasing off the balloons 4 into the air, the tied ends of the locking elements 10 may be untied and then, the locking elements 10 may be pulled. This causes the locking elements 10 entangled in the meshes of the upper nets 17, 17a and on the locking ropes 12 to be loosed in a direction opposite to the locking direction, whereby the locking of the openable locations of the upper nets 17, 17a is released, so that the balloons 4, 4 - - - in the storages 16 are released off to the outside. In this case, an ascending force by the balloons 4 in each storage 18 acts as a force for pulling away the locked nets at the portions locked by the locking element 10, and even in the present embodiment, such ascending force becomes a force for releasing the locking by the locking element 10 as in the previous embodiment. Thus, a larger pulling force is not required for releasing of the locking by the locking element 10 and yet, releasing of the locking by the locking element 10 is reliably and rapidly conducted. Accordingly, even a picture of a complicated stationary pattern can be reliably revealed, and the balloons 4 can be flied off. This makes it possible to determine any shape of the stationary pattern at will and further to freely select the timing of releasing the locking at the individual components of the stationary pattern.

In this embodiment, the lower net and the upper nets 17, 17a are locked to each other by the locking element 10 to form empty storages 18, 18, - - - in the above manner, and therefore, each of the storages 18, 18 - - - is formed in accordance with the shape of the draft drawn on the lower net 16, thereby providing an intended stationary pattern. The locking by the locking element 10 can be carried out indoors, and the locked lower and upper nets 16 and 17, 17a can be transported in a rolled-up state to a site where they are to be placed and hence, such transportation is easy. In addition, the balloons 4 are packed to each of the storages 18 already closed around their entire peripheries, and it is only necessary to fill helium gas into the balloon via the check valve 11 and through the filling nozzle. Therefore, such operation is extremely simple and rapid. Further, it is eliminated that the inflated balloons cannot be flied out of the storage 18 by the wind, leading to no influence by the wind and an eliminated waste of the balloons.

While the size of the mesh of each upper net 17, 17a has been such that the locking by the locking element 10 can be provided in the above-described embodiment, it is to be understood that if the mesh is smaller, the locking rope 12 may be attached to the openable locations as with the lower net 16. On the other hand, if use is made of a net having meshes of a size enough to enable the locking by the locking element 10, the locking rope 12 may be dispensed with, and such meshes may be utilized to perform the locking by the locking element 10.

Additionally, although the balloons each having the check valve 11 have been employed in the above embodiment, balloons having no check valve 11 may be used, and after inflation, the balloons may be bound or fastened at their openings and packed into the storage 18. In this case, the locking of the lower net 16 with the upper nets 17, 17a by the locking element 10 and packing of the balloons 4 may be conducted sequentially from the uppermost locked portion to the lowermost portion, and balloons 4 having colors corresponding to the colors of components of a stationary pattern may be packed.

Those locations of the end edges of the upper net 17, 17a which are to be opened for releasing-off of the balloons may be only placed required for releasing-off of the balloons, and in the above embodiment, the lower and edge of the upper nets 17, 17a may be secured. This may be suitably selected depending upon the shape of a stationary pattern of the like.

A lacing 5 as used in the prior art may be employed as a locking element for locking the upper and lower nets.

Further, although the two nets, i.e., the upper and lower nets have been used to form the storages in the above embodiment, one net material or three or more net materials may be used to form storages.

It will be understood that the present invention is not limited to the above-described embodiments, and variations and modifications may be made as necessary without departing from the spirit and scope of the invention.

What is claimed is:

1. A balloon storage system comprising a storage means for containing balloons, having balloons therewithin, comprising:

a. a net, for surrounding said balloons, having meshes smaller in size than said balloons when said balloons are inflated; and b. a means for releasably locking edges of the net together comprising a locking element intertwined at most with longitudinally alternate ones of longitudinally adjacent net meshes which are transversely paired with corresponding meshes of said net at adjoining net edges, at least a portion of said locking element being in a chain stitch configuration, said storage system being capable of releasing said balloons by unlocking said locking element thereby permitting said adjoining net edges to separate for passage of said balloons therebetween.

2. The storage system of claim 1 wherein the storage means is cylindrically-shaped when filled with inflated balloons.

3. The storage system of claim 1 wherein the chain stitch portion of the locking element has a diameter smaller than said balloons.

4. A balloon storage system for containing a plurality of balloons therewithin and being capable of releasing said balloons when actuated by an operator, comprising:

a. a plurality of balloons capable of being inflated;

b. an upper net having meshes smaller in diameter than said balloons when said balloons are inflated;

c. a lower net having meshes smaller in diameter than said balloons when said balloons are inflated;

d. respective edges of said upper and lower nets meeting to define openable locations at which vertices of respective meshes of said upper and lower nets are aligned and adjacent one another in substantially a one-to-one relationship and e. a locking element releasably locking openable locations on the upper net to openable locations on the lower net, said locking element being intertwined with said nets at said openable locations, at least a portion of said locking element being in a chain stitch configuration, loops of said chain stitch configuration passing through at most alternate pairs of said aligned and adjacent meshes of said upper and lower nets;

wherein said nets surround the balloons when said balloons are inflated and the locking element is engaged; and wherein said storage system is capable of releasing said balloons at said openable locations by an operator manually unlocking said locking element.

5. The balloon storage system of claim 4 wherein the chain stitch portion of the locking element has a diameter smaller than said balloons.

6. The balloon storage system of claim 4 wherein the openable locations of the upper net are outer edges of the upper net and locations on the upper net which follow along a pattern sketched on the lower net.

7. The balloon storage system of claim 4 wherein at least one of said nets comprises a locking rope at one of its openable locations whereby said intertwining comprises intertwining of said locking rope and said locking element.

8. A system for storing and releasing balloons for entertainment upon action of an operator, comprising:

a. a net, for surrounding balloons of a preselected size when inflated, said net having meshes smaller in size than said balloons when said balloons are inflated, two longitudinally extending edges of said net being adjacent one another with respective meshes of said longitudinally extending edges being transversely substantially aligned; and b. sinuous means in chain stitch configuration for releasably locking said longitudinally extending net edges together, intertwined at most with transversely paired longitudinally alternate ones of longitudinally adjacent net meshes of said longitudinally extending edges; said system releasing any balloons stored therewithin by said operator pulling one end of said sinuous means to unlock said releasable locking means by serially removing said sinuous means from said transversely paired longitudinally alternate ones of longitudinally adjacent net meshes of said longitudinally extending edges thereby permitting said transversely paired longitudinally alternate ones of longitudinally adjacent net meshes of said longitudinally extending edges to separate for passage therebetween of any said balloons contained in said system to.

9. A system for storing and releasing a plurality of balloons when actuated by an operator, comprising:

a. an upper net having meshes smaller in maximum dimension than diameter of balloons of a preselected inflated size when said balloons are inflated;

b. a lower net having meshes smaller in maximum dimension than said balloons when inflated;

c. respective longitudinally elongated edges of said upper and lower nets meeting to define an openable location at which vertices of respective meshes of said upper and lower nets are substantially transversely aligned in substantially a one-to-one relationship and d. sinuous means for releasably locking said meshes of said upper net to said meshes of said lower net at said openable location, intertwined with said meshes of said nets at said openable location, at least a portion of said sinuous means for releasable locking said meshes being in chain stitch configuration, loops of said chain stitch configuration passing through at most longitudinally alternate ones of said transversely aligned pairs of meshes of said upper and lower nets;

wherein said nets may surround any inflated balloons of at least said preselected size when said balloons are inflated and said sinuous releasable locking means is intertwined with meshes of said upper and lower nets at said openable location; and wherein said storage system is capable of releasing said balloons at said openable location by an operator manually pulling on one end of said sinuous means to longitudinally serially remove said sinuous means from said transversely aligned pairs of meshes of said upper and lower nets.

10. A system for storing and releasing balloons for entertainment upon action of an operator, comprising:

a. mesh means for surrounding balloons of a preselected size when inflated;

i. meshes of said mesh means being smaller in size than said balloons when inflated;

ii. said mesh means having longitudinally extending edges adjacent one another;

iii. respective meshes of said longitudinally extending edges being transversely substantially aligned;

b. sinuous means for releasably locking said longitudinally extending mesh means edges together, intertwined with transversely paired ones of meshes respectively associated with and proximate said longitudinally extending edges;

i. said sinuous means including loops formed therein;

(1) said loops passing through meshes associated with a first one of said longitudinally extending edges;

(2) said loops passing through immediately succeeding loops;

(3) said loops passing through said meshes associated with one of said longitudinally extending edges from a first side to a second side of said mesh means;

(4) said loops passing through said immediately succeeding loops on said second side of said mesh means;

ii. said sinuous means extending along meshes defining the mesh means remaining longitudinally extending edge along said second side of said mesh means;

iii. portions of said sinuous means intermediate respective loops extending along said second mesh means side of said remaining longitudinally extending edge connecting with respective loops which are substantially transversely aligned with said sinuous means portions by passing from said second side to said first side of said mesh means through a mesh of said remaining longitudinally extending edge and by passing from said first side to said second side of said mesh means through a mesh of said first longitudinally extending edge; and c. said meshes through which respective portions of said sinuous means extend being substantially transversely aligned;

d. said sinuous means releasably disengaging simultaneously from said meshes of a transverse pair when said operator pulls an end of said sinuous means.

11. The system of claim 10 wherein said sinuous means is intertwined at most with transversely paired longitudinally alternate ones of longitudinally aligned meshes defining said longitudinally extending edges.

12. The system of claim 11 wherein vertices of said meshes define said longitudinal edges.

13. The system of claim 12 wherein respective vertices of said respective longitudinally extending edges are substantially transversely aligned in one-to-one relationship.

14. The system of claim 13 wherein said respective transversely aligned vertices define transverse extremities of said longitudinally extending edges.

15. The system of claim 14 wherein said sinuous mean is intertwined with said meshes proximate said transversely aligned vertices defining said transverse extremities of said longitudinally extending mesh means edges.

16. The system for storing and releasing balloons of claim 10 wherein said sinuous means disengages simultaneously from said meshes of a transverse pair by said loops serially withdrawing from immediately preceding loops and passing through said meshes of a transverse pair serially from said first side to said remaining side and from remaining side to said first side of respective meshes of a transverse pair.

17. A system for storing and releasing balloons for entertainment upon action of an operator, comprising:

a. first and second nets for together surrounding balloons of a preselected size when inflated;

i. said nets having meshes smaller than said balloons when inflated;

ii. said second net having a longitudinally extending edge adjacent to said first net;

b. first sinuous locking means intermittently secured to said first net along at least a portion of said second net longitudinal edge;

c. second sinuous means for releasably locking said first and second nets together generally along said longitudinally extending second net edge, intertwined with said first sinuous locking means intermediate said positions of intermittent securement of said first sinuous locking means to said first net;

i. said second sinuous means being formed into loops;

(1) said loops passing through net meshes along said longitudinally extending edge of said second net;

(2) said loops passing through immediately succeeding loops;

(3) said loops passing through said net meshes along said longitudinally extending edge of said second net from a first side to a second side of said second net;

(4) said loops passing through said immediately succeeding loops on said second side of said second net;

d. said second sinuous means disengaging from said second net and from said first sinuous means upon said operator pulling an end of second sinuous means by said loops serially withdrawing from immediately preceding loops and passing through meshes of said second net.

18. The system of claim 17 wherein:

a. said loops pass through longitudinally alternate ones of longitudinally adjacent net meshes;

b. said longitudinally adjacent net meshes define said longitudinally extending edge;

c. said second sinuous means is arranged in a pattern defining a recognizable character or object; and d. at least one of said nets is generally planar and vertically oriented.

* * * * *